United States Patent [19]

Schaller

[11] 4,201,383

[45] May 6, 1980

[54] SIMULATED FOOTBALL GAME

[76] Inventor: Joseph P. Schaller, 1884 Bairsford Dr., Columbus, Ohio 43227

[21] Appl. No.: 889,389

[22] Filed: Mar. 23, 1978

[51] Int. Cl.[2] ..... A63F 7/06

[52] U.S. Cl. ..... 273/94; 273/14

[58] Field of Search ..... 273/94, 14, 87.2

[56] References Cited

U.S. PATENT DOCUMENTS

| | | | |
|---|---|---|---|
| 1,603,717 | 10/1926 | Rubino et al. | 273/94 R |
| 1,929,757 | 10/1933 | Sargent | 273/94 R |
| 2,140,193 | 12/1938 | Weinberger | 273/94 R |
| 2,658,757 | 11/1953 | Elder | 273/94 R X |
| 2,750,192 | 6/1956 | Haslett | 273/87.2 |
| 2,828,964 | 4/1958 | Horton | 273/94 R |
| 4,063,728 | 12/1977 | Zemanek | 273/14 X |

*Primary Examiner*—Paul E. Shapiro

*Attorney, Agent, or Firm*—Frank H. Foster

[57] ABSTRACT

A football contest is realistically simulated with a compressibly deformable, high friction, energy absorbing playing field mat having football field indicia thereon and supported on a raised table. The players are simulated by balls positioned in football formations on the mat and then rolled or propelled by stick or finger along the mat into collisions. These balls are sufficiently heavy to compress the mat for quickly dissipating their kinetic energy into said mat. The football is simulated by a foam oblate spheroid.

4 Claims, 3 Drawing Figures

SIMULATED FOOTBALL GAME

BACKGROUND OF THE INVENTION

This invention relates generally to games and more particularly relates to a football game closely simulating a conventional football game and requiring the exercise of considerable physical and mental skill.

The game of football has, progressively over the past several years, greatly increased in popularity and appeal. This appeal is not limited to direct participation as a player or to passive participation as a spectator. The appeal of football to large segments of our population extends additionally to active participation in simulated football games.

Many people who are unable to participate as a player, but who desire to do more than inactively watch a football game, find great pleasure in participating in the simulated football games that are currently available. The closer and more accurately the game simulates conventional football, the more enjoyable the game becomes. One disadvantage of many of the current simulated football games is that they rely either solely on chance, leaving no skill to be exercised by the player, or they rely on a combination of chance and mental skills. Current simulated games use vibrators, dice, cards, spinners or even computers and similar devices which take away much of the direct competition between the skills of the players. Results in such games are often predetermined and then stored in a computer, on printed cards or on other storage devices.

There is therefore a need for a simulated football game which can permit a contest of physical and mental skill between two or more players because conventional football is a contest in part between physical skills. Such a game would advantageously permit direct physical competition by the participants and would encourage the development and improvement of skills which would aid a player in defeating his opponent.

SUMMARY OF THE INVENTION

The invention is a ball game apparatus for playing simulated football contests, both of the American and European type. The apparatus has a high friction, energy absorbing mat having football playing field indicia thereon and having a generally horizontal operable position. A plurality of spherical balls are positioned on the mat. The balls have a weight which is sufficient to significantly compress the mat for efficiently dissipating their kinetic energy into the mat when they are rolled across the mat. A plurality of sticks are used to propel the balls in the manner that billiard balls are propelled.

It is an object of the invention to provide an improved game for simulated football or other games.

Another object of the invention is to provide a football game which encourages and requires physical and mental skills in playing the game.

Another object of the invention is to provide a football game which very closely simulates an actual football contest and therefore permits a participant to use his general knowledge of conventional football.

Yet another object of the invention is to provide a simulated football game with negligible dependence upon chance.

Further objects and features of the invention will be apparent from the following specification and claims when considered in connection with the accompanying drawings illustrating the preferred embodiment of the invention.

Figure 1:
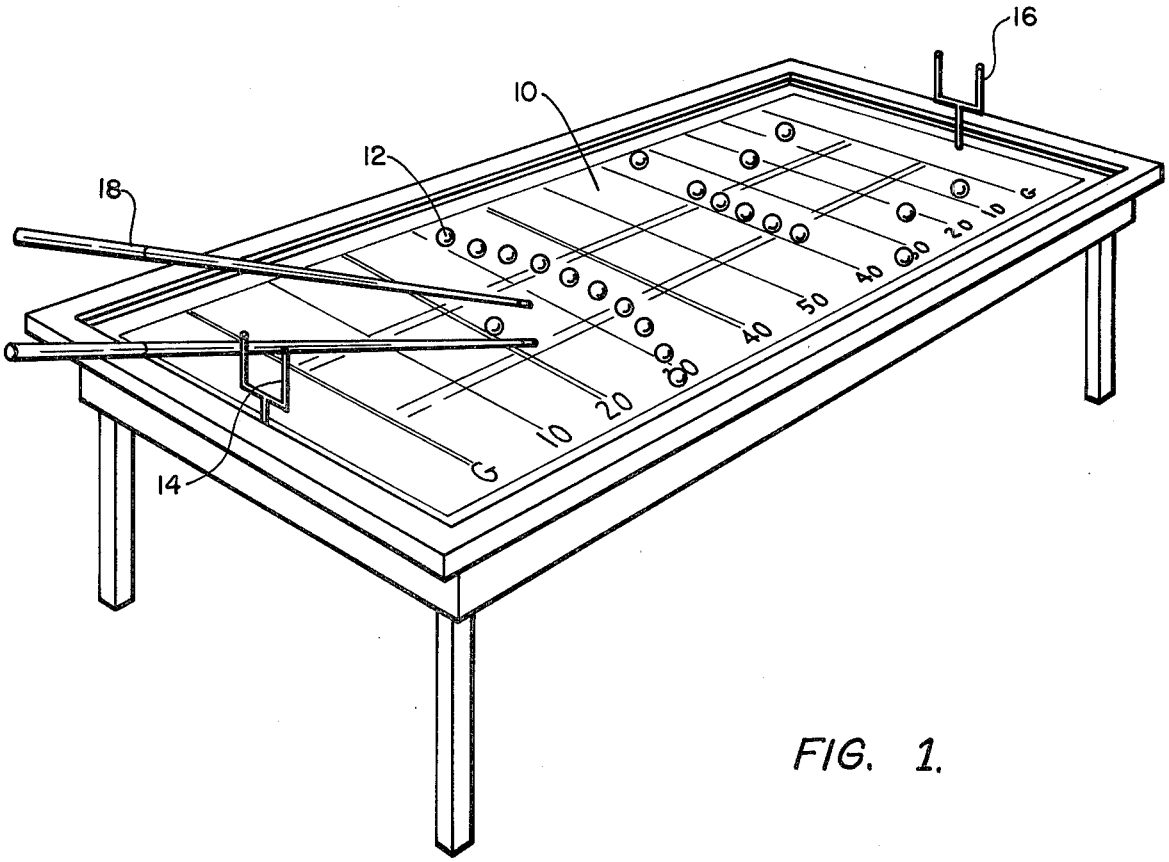
FIG. 1 is a view in perspective of a preferred embodiment of the invention showing the player-simulating balls positioned in football formation.
Figure 2:
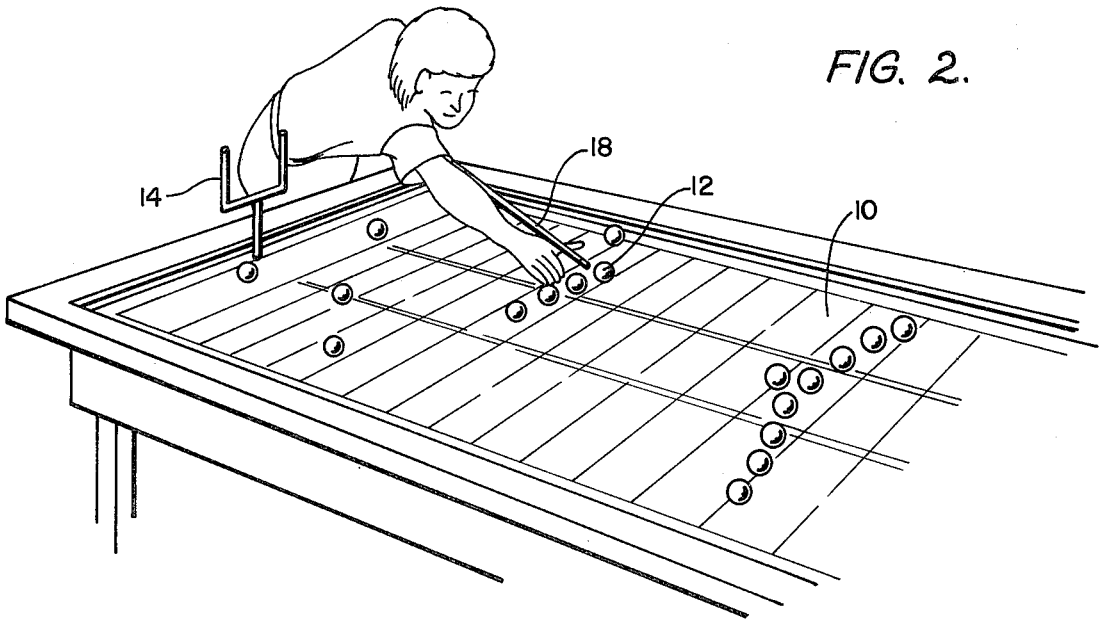
FIG. 2 is a view in perspective of the embodiment illustrated in FIG. 1 with the balls positioned after play has commenced and illustrating a player engaged in playing the game.
Figure 3:
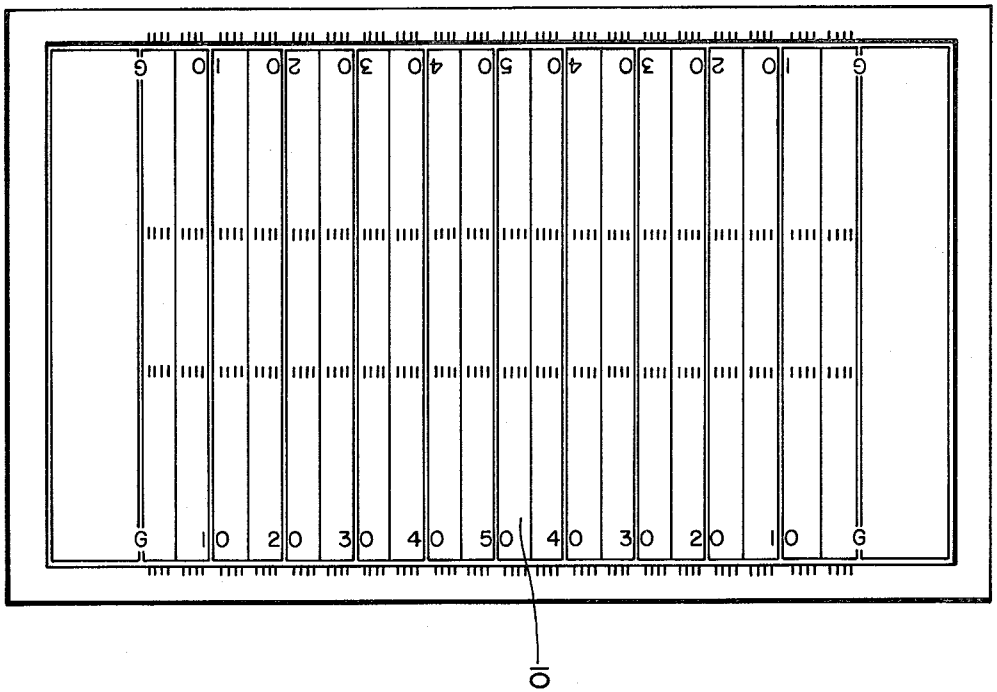
FIG. 3 is a plan view of the playing field mat of FIG. 1.

In describing the preferred embodiment of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DETAILED DESCRIPTION

As illustrated in FIG. 1, the playing field 10 of the invention is a sheet of course pile artificial turf, approximately ½ inch thick and having a length, width and indicia thereon which correspond to those of a conventional football field. The preferred playing field has a length of 90 inches and a width of 40 inches. Alternative indicia can, of course, be used to represent a football game as played in Canada or to represent European type football commonly called Soccer.

A plurality of hard rubber or synthetic resin polymer balls 12, approximately 1½ inches in diameter are positioned on the mat 10. Conventional golf balls may be used. The balls 12 as illustrated in FIG. 1 are equal in quantity to the number of players found on a conventional football field. Thus, an offensive team, illustrated in white in FIG. 1, has eleven balls each corresponding to a player of a conventional football team. The player-simulating balls are positioned in formations analagous to a conventional football formations.

The defensive team, similarly has eleven player-simulating balls positioned in a defensive position. As described below, the balls 12 are propelled along the mat 10 into collisions with the balls of the opponent.

The playing field material is advantageously made of indoor-outdoor turf type carpet which may be conveniently rolled and stored and easily unrolled and readied for play. Most importantly, however, I have discovered that a material selected to have the proper compressibility and frictional characteristics and balls having the proper weight, size and elasticity may advantageously be combined to improve the realism of the simulated football game.

Using a high friction playing field mat in combination with balls which have a sufficient weight to substantially compress the mat and efficiently dissipate the kinetic energy of the rolling ball into the mat permits the simulated football game to more realistically approach the play of an actual football game. By causing the balls to quickly come to a halt, and by preventing substantial rolling of the balls after a collision, the game is made to more realistically approach conventional football.

The energy absorbing cooperation between a ball 12 and the mat 10 is the characteristic which provides this realistic simulation. As the ball 12 rolls on the mat 10, it causes a mat depression 22 to travel beneath it. The depression results from the depression of individual pile tufts as the ball travels. The energy needed to depress the tufts is taken from the kinetic energy of the ball.

Advantageously, the balls are made of different colors to distinguish the teams and additionally are marked with a letter such as Q for quarterback or F for fullback to indicate the position of that player. This aids in simplifying the quick understanding of the progression of each play.

Goal posts 14 and 16 may be provided which consist of miniaturized wood or plastic goal posts which are supported on a base beneath the field mat.

To further improve the accurate simulation of conventional football, I provide a synthetic resin foam oblate spheroid football made of, for example, urethane foam. Such a football has the desirable characteristic that it may be propelled through the air to simulate a kick or a pass by means of the index finger of the player. We have found that such a ball when made approximately 1 and ½ inches long has a weight and size particularly suitable for simulating a football game.

In general, the game is played by propelling the balls with a stick 18, such as a conventional billiard or pool Q stick to simulate the movement on the ground of a player. Passes and kicks are simulated by propelling the foam football through the air from one point on the field to another by means of the index finger or thumb of the participant. Prior to each play, the balls are positioned in positions which are analogous to those of conventional football and their movements are governed by the rules applicable thereto.

For example, a game may be begun by a flip of a coin and the subsequent positioning of the offensive and defensive player simulating balls in kick-off and kick-off receiving positions. The participant, whose team will kick-off, positions the foam football at the 35 yard line and flips it down the field into the backfield of the receiving team. The result of a kick-out of bounds or a kick into or past the end zone of the receiving team will have the same results as in conventional football. The kick-off play now progresses with the players alternately taking their moves. The receiving participant must move a ball into contact with the simulated football to accomplish receipt of a kick-off. Failure to do so indicates a free ball and the kicking team has an opportunity to collide with the simulated foam football and thereby recover it. A ball carrier is tackled by being struck in a collision by a player-simulating ball from the other team. The players alternately propel the player-simulating balls of their team to provide blocking, tackling and running.

Plays from scrimmage operate in a similar manner. The player-simulating balls of the two teams are aligned in conventional football formations with the offensive participant initiating play. He may do so by moving a blocker or a ball carrier in a desired direction within the rules. The defensive team then may move a ball and attempt to tackle the ball carrier or remove a blocker. The play progresses with the alternate propelling of the team balls by the opponents until the offensive player carrying the ball crosses the goal line or is involved in a collision with a defensive player.

A pass may be simulated by propelling the foam football through the air from the offensive team's backfield into contact with a downfield receiver. Contact with a defensive player is an interception.

The above rules are of course only suggestive and players may adopt rules which seem appropriate to them. For example, they may adopt appropriate rules for penalties, punts and field goals in addition to modifications of the rules above. The important fact is that by providing a simulated football game in which the ball rolling is greatly inhibited by the relationship of the player-simulating balls to the mat material, simulated football game rules and action may be devised which conform closely to the rules and action of an actual football game.

One modification of the rules might be that the defensive participant may be permitted to propel the defensive play-simulating ball instantly after the offensive player propels his player-simulating ball. Therefore, I have devised a game in which the ability of a player to defeat his opponent depends upon his physical skill in propelling accurately and intelligently, the player-simulating balls of his team in a manner superior to the ability of opponent to do so. Chance and predetermination of results are completely eliminated.

It is to be understood that while the detailed drawings and specific examples given describe preferred embodiments of the invention, they are for the purpose of illustration, that the apparatus of the invention is not limited to the precise details and conditions disclosed and that various changes may be made therein without departing from the spirit of the invention which is defined by the following claims:

I claim:

1. A game for playing simulated football games, said game comprising:

(a) a high friction playing field mat having football playing field indicia thereon;

(b) a plurality of balls on said mat for simulating players, said balls having a weight sufficient to substantially compress said mat for efficiently dissipating their kinetic energy;

(c) a plurality of sticks for manually striking and propelling said balls; and (d) a synthetic resin foam, oblate spheroid for being propelled over said mat simulating a football.

2. A game according to claim 1 wherein said mat comprises a course pile carpet.

3. A game according to claim 1 wherein said mat comprises a resiliently compressible synthetic resin foam.

4. A game according to claim 1 wherein said balls comprise golf balls.

* * * * *